US007957944B2

(12) United States Patent
Herbst

(10) Patent No.: US 7,957,944 B2
(45) Date of Patent: Jun. 7, 2011

(54) USING HISTORICAL DATA TO ESTIMATE WEAR PROFILES OF CONSUMABLE WEAR PRODUCTS

(75) Inventor: Eric Herbst, Minneapolis, MN (US)

(73) Assignee: Servicios Y Consultorias Hendaya SA, Santiago (CL)

( * ) Notice: Subject to any disclaimer, the term of this patent is extended or adjusted under 35 U.S.C. 154(b) by 832 days.

(21) Appl. No.: 11/834,901

(22) Filed: Aug. 7, 2007

(65) Prior Publication Data

US 2008/0188958 A1 Aug. 7, 2008

Related U.S. Application Data

(60) Provisional application No. 60/821,614, filed on Aug. 7, 2006.

(51) Int. Cl.

| | |
|---|---|
| ***B02C 4/32*** | (2006.01) |
| ***B02C 7/14*** | (2006.01) |
| ***B02C 9/04*** | (2006.01) |
| ***B02C 11/08*** | (2006.01) |
| ***G06G 7/48*** | (2006.01) |

(52) U.S. Cl. ..... 703/7; 241/37

(58) Field of Classification Search ..... 703/7; 241/37
See application file for complete search history.

(56) References Cited

U.S. PATENT DOCUMENTS

| | | | | |
|---|---|---|---|---|
| 4,018,393 | A | 4/1977 | Larsen | |
| 4,165,041 | A | 8/1979 | Larsen | |
| 4,235,386 | A | 11/1980 | Larsen | |
| 4,243,182 | A | 1/1981 | Dugger, Jr. | |
| 4,319,719 | A | 3/1982 | Larsen | |
| 5,042,732 | A * | 8/1991 | Karra et al. | 241/207 |
| 5,580,003 | A | 12/1996 | Malone et al. | |
| 5,704,436 | A * | 1/1998 | Smith et al. | 175/27 |
| 6,082,646 | A | 7/2000 | Clarke | |
| 6,343,756 | B1 | 2/2002 | Weil | |
| 2002/0046012 | A1 * | 4/2002 | Takemura et al. | 703/2 |
| 2005/0116077 | A1 | 6/2005 | Herbst et al. | |
| 2005/0242217 | A1 * | 11/2005 | Nilsson et al. | 241/30 |

FOREIGN PATENT DOCUMENTS

| | | |
|---|---|---|
| DE | 31 36 434 A1 | 3/1983 |
| JP | 7-275726 | 10/1995 |
| WO | WO 93/00997 | 1/1993 |
| WO | WO 02/092245 A1 | 11/2002 |

OTHER PUBLICATIONS

Chandramohan et al., *A Structured Approach to Modelling SAG Mill Liner Wear—Monitoring Wear*, Department of Mining Engineering, University of British Columbia, Vancouver, B.C., Canada, SAG 2006, pp. III-133 through III-148, dated Sep. 2006.

(Continued)

*Primary Examiner* — Dwin M Craig
(74) *Attorney, Agent, or Firm* — Merchant & Gould P.C.

(57) ABSTRACT

An example method for estimating a wear profile of a consumable wear product used in conjunction with the processing of ore includes obtaining historical data related to wear of the consumable wear product, building a historical wear model based on the historical data, and obtaining a current single measurement point for the consumable wear product. The method includes extrapolating an estimated wear profile using the current measurement point and the historical wear model, and estimating a performance characteristic based on the estimated wear profile.

4 Claims, 9 Drawing Sheets

OTHER PUBLICATIONS

Franke et al., *Millmapper: A New Tool for Grinding Mill Thickness Gauging*, Department of Mining Engineering, University of British Columbia, Vancouver, B.C., Canada, SAG 2006, pp. III-75 through III-87, dated Sep. 2006.

McBride et al., *A Structured Approach to Modelling SAG Mill Liner Wear—Numerical Modelling of Liner Evolution*, Department of Mining Engineering, University of British Columbia, SAG 2006, pp. III-120 through III-132, dated Sep. 2006.

Powell et al., *The Value of Rigorous Surveys, The Los Bronces Experience*, Department of Mining Engineering, University of British Columbia, Vancouver, B.C., Canada, SAG 2006, pp. I-233 through I-248, dated Sep. 2006.

Radziszewski et al., *Investigating the Feasibility of Liner Wear Sensor Development*, Department of Mining Engineering, University of British Columbia, Vancouver, B.C., Canada SAG 2006, pp. III-149 through III-159, dated Sep. 2006.

International Search Report and Written Opinion mailed Dec. 17, 2007.

* cited by examiner

FIGURE 2

200

| 210 A | 212 B | 214 C | 216 D | 218 E | 220 F |
|---|---|---|---|---|---|
| 3.89 | 3.77 | 3.65 | 3.54 | 3.33 | 3.12 |
| 3.91 | 3.79 | 3.65 | 3.55 | 3.33 | 3.1 |
| 3.94 | 3.82 | 3.68 | 3.58 | 3.33 | 3.06 |
| 3.98 | 3.86 | 3.71 | 3.6 | 3.34 | 3.03 |
| 4.03 | 3.89 | 3.74 | 3.56 | 3.37 | 3.02 |
| 4.13 | 4.07 | 3.77 | 3.66 | 3.4 | 3.01 |
| 4.08 | 3.95 | 3.81 | 3.69 | 3.43 | 3 |
| 4.08 | 3.98 | 3.85 | 3.72 | 3.46 | 3 |
| 4.11 | 4.01 | 3.89 | 3.74 | 3.49 | 3.02 |
| 4.14 | 4.04 | 3.94 | 3.76 | 3.51 | 3.08 |
| 4.16 | 4.07 | 3.99 | 3.8 | 3.53 | 3.14 |
| 4.19 | 4.09 | 4.01 | 3.84 | 3.56 | 3.2 |
| 4.2 | 4.11 | 4.02 | 3.87 | 3.6 | 3.31 |
| 4.21 | 4.13 | 4.03 | 3.91 | 3.65 | 3.44 |
| 4.23 | 4.16 | 4.03 | 3.95 | 3.71 | 3.55 |
| 4.3 | 4.2 | 4.11 | 4.05 | 3.79 | 3.7 |
| 4.5 | 4.4 | 4.31 | 4.23 | 3.93 | 3.8 |
| 4.81 | 4.7 | 4.57 | 4.48 | 4.16 | 4.06 |
| 5.22 | 5.14 | 4.99 | 4.85 | 4.57 | 4.43 |
| 7.48 | 6.66 | 5.97 | 5.65 | 5.49 | 4.78 |
| 11.86 | 10.63 | 8.32 | 6.98 | 5.97 | 4.84 |
| 12.94 | 10.84 | 8.33 | 7.19 | 6.2 | 4.88 |
| 13.06 | 10.91 | 8.33 | 7.32 | 6.32 | 4.92 |
| 13.11 | 10.82 | 8.27 | 7.41 | 6.39 | 4.96 |
| 13.06 | 10.7 | 8.23 | 7.41 | 6.44 | 4.99 |
| 12.99 | 10.58 | 8.16 | 7.37 | 6.48 | 5.02 |
| 12.86 | 10.44 | 8.07 | 7.32 | 6.46 | 5.04 |
| 12.73 | 10.3 | 7.96 | 7.23 | 6.41 | 5.04 |
| 12.55 | 10.16 | 7.83 | 7.11 | 6.31 | 5.04 |
| 12.38 | 9.96 | 7.7 | 6.99 | 6.21 | 5.03 |
| 12.06 | 9.76 | 7.53 | 6.87 | 6.1 | 5.03 |
| 11.7 | 9.56 | 7.36 | 6.72 | 5.98 | 5.02 |
| 11.32 | 9.24 | 7.14 | 6.53 | 5.84 | 4.94 |
| 10.7 | 8.83 | 6.87 | 6.31 | 5.67 | 4.86 |
| 9.91 | 8.2 | 6.56 | 5.99 | 5.47 | 4.71 |
| 8.72 | 7.49 | 6.13 | 5.61 | 5.13 | 4.5 |
| 7.38 | 6.64 | 5.49 | 5.07 | 4.69 | 4.24 |
| 5.84 | 5.77 | 4.79 | 4.34 | 4.16 | 3.81 |
| 3.2 | 3.2 | 3.2 | 3.2 | 3.2 | 3.2 |

230

| | | | | | |
|---|---|---|---|---|---|
| 13.11 | 10.91 | 8.33 | 7.41 | 6.48 | 5.04 |

240

970

USING HISTORICAL DATA TO ESTIMATE WEAR PROFILES OF CONSUMABLE WEAR PRODUCTS

BACKGROUND

When ore is mined, it is generally in large fragments that must be reduced in size for further refining. Several types of ore comminuters or reducers can be used, one of which takes the form of a large cylindrical closed drum that is rotated on a horizontal axis in a single direction or in both directions (i.e., bi-rotationally). Ore is introduced into one end of the drum through an inlet, and, after reduction or comminution, the reduced ore is discharged through an outlet in the opposite end. Within the drum, the charge of ore fragments rests at the bottom of the rotating drum. As the drum rotates, part of the ore charge is carried upwardly along the irregular inner surface of the drum until the carried fragments drop from the drum surface due to gravity, tumbling back onto the ore charge and breaking the fragments. This continuous process results in reduction of the fragments to a predetermined size, at which time they are discharged from the mill.

The inner cylindrical surface of the drum is fitted with a liner assembly made up of individual liner segments arranged in circumferential and axial rows. The liner segments can be made using various techniques and materials. For example, the liner segments can be cast from alloys, or can be made from rubber, ceramics, or magnetic materials.

Typically, the liner segments are designed to optimize the wear rate while avoiding breakage by being too hard and brittle. Each of the liner segments has a slightly convex bottom surface that conforms to the radius of curvature of the cylindrical drum and a top surface that is irregular in shape. The liner segments together typically define axially extending ridges and valleys that facilitate lifting of the ore fragments as the drum is rotated. Examples of such liner assemblies are disclosed in U.S. Pat. Nos. 4,018,393, 4,165,041, 4,235,386, 4,243,182, 4,319,719, 6,082,646, and 6,343,756, all of which are hereby incorporated by reference in their entireties.

Ore comminuting mills of this type generally run twenty-four hours a day for economic efficiency. The continuous process wears the liner segments down over a period of time, which will depend on the type of ore and application, after which the liner assembly must be replaced. Because down time of the ore comminuting mill adversely effects the economic efficiency of the process, it is desirable to identify when the liner assembly has been worn to the point of requiring replacement, and to change the liner assembly as quickly as possible. In addition, various other operating factors can affect the wear rate of the liner assembly and overall performance of the mill.

Current methods for measuring the wear of liner assemblies typically involve the manual measurement of multiple segments of the liner to estimate wear. For example, some processes require twenty or more measurements to be taken to estimate liner wear. This measurement process can be tedious and time-consuming. Further, the mill must be shut down during the process. It is therefore desirable to optimize the ease and speed at which performance determinations such as wear can be made.

SUMMARY

Example embodiments disclosed herein relate to systems and methods for estimating performance characteristics based on historical data.

According to one aspect, an example method for estimating a wear profile of a consumable wear product used in conjunction with the processing of ore includes obtaining historical data related to wear of the consumable wear product, building a historical wear model based on the historical data, and obtaining a current single measurement point for the consumable wear product. The method includes extrapolating an estimated wear profile using the current measurement point and the historical wear model, and estimating a performance characteristic based on the estimated wear profile.

According to another aspect, a user interface is stored on a tangible computer readable medium, the user interface including an estimated wear profile that is displayed to a user, the estimated wear profile being generated based a current single measurement point and historical wear data for a liner assembly.

DESCRIPTION OF THE DRAWINGS

Reference will now be made to the accompanying drawings, which are not necessarily drawn to scale, and wherein:

FIG. 2 illustrates an example table including historical wear data;

DETAILED DESCRIPTION

Example embodiments will now be described more fully hereinafter with reference to the accompanying drawings. These embodiments are provided so that this disclosure will be thorough and complete. Like numbers refer to like elements throughout.

Example embodiments disclosed herein relate to systems and methods for estimating performance characteristics based on historical data. In example embodiments, estimated wear of consumable wear products, such as a liner assembly of a grinding mill, is performed. In some embodiments, historical data is analyzed to build a wear model. The wear model is used to estimate the wear of the liner assembly based on one or more current measurements of liner thickness. The estimate of wear can be used to determine when replacement of the liner assembly is desirable.

Figure 1:
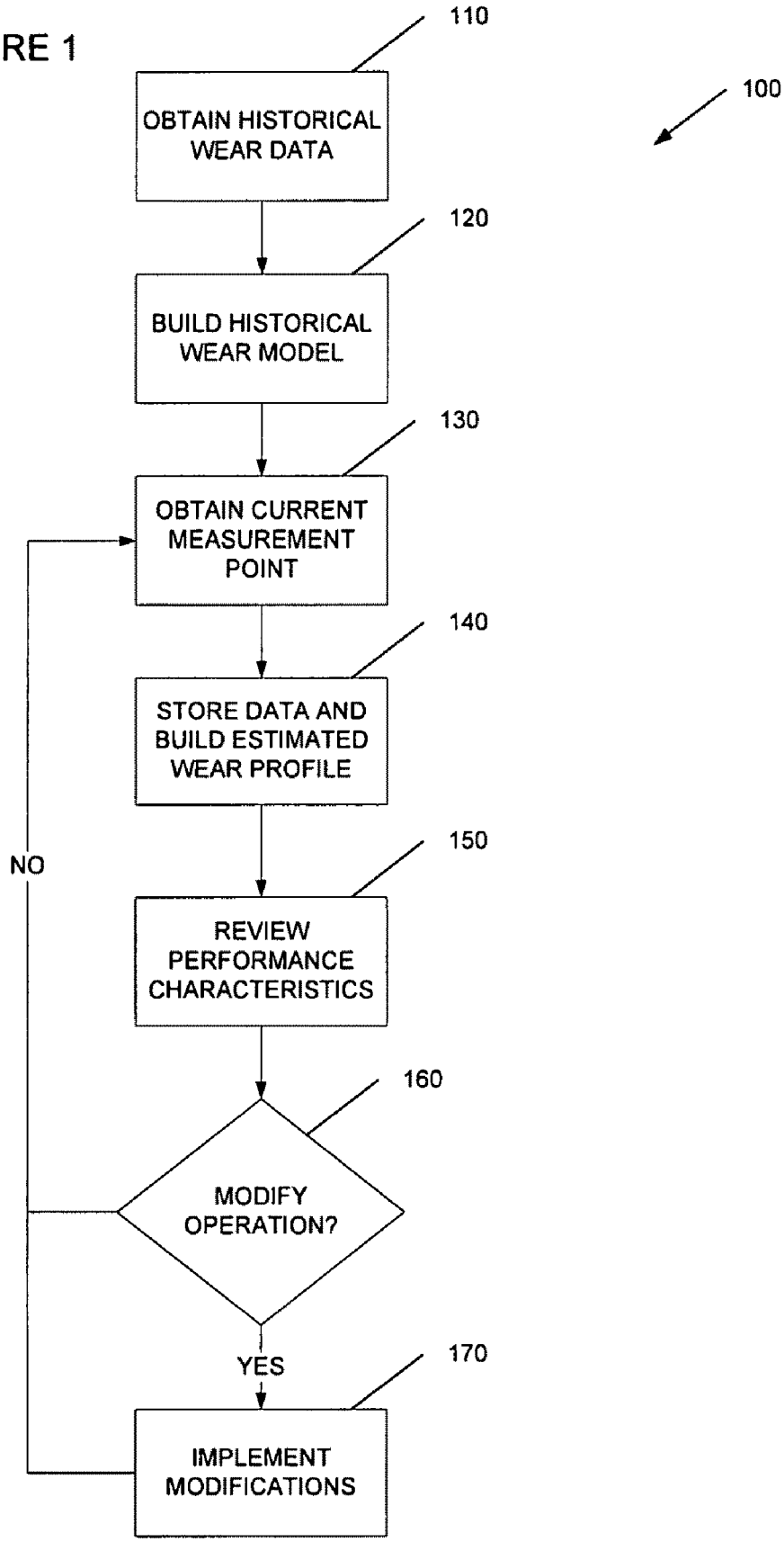
FIG. 1 illustrates an example method for estimating a wear profile based on historical wear data.

Referring now to FIG. 1, an example method 100 for estimating the wear of a liner assembly is shown. Method 100 begins by obtaining historical wear data at operation 110. The historical wear data can be obtained in various manners. For example, the historical wear data may be available from data that was previously recorded from measurements of previous liner assemblies used in the grinding mill. In other examples, the historical wear data may be available from data collected at other grinding mills using the same or similar liner assemblies or from the manufacturer of the liner assembly. In yet other examples, the historical wear data can be assembled by taking measurements over the life cycle of one or more other liner assemblies.

Once the historical wear data is obtained, control is passed to operation 120, and a historical wear model is built. In example embodiments, the historical wear model is constructed by plotting the historical data.

Next, at operation 130, the thickness of the current liner assembly is measured. In example embodiments, the thickness is measured at a single point using an ultrasonic thickness device. In one embodiment, the single point is selected as the highest point of the liner assembly (i.e., the point of greatest thickness for the liner assembly) because the highest point is parallel to the back face of the liner. In other embodiments, other points, such as the lowest point, can be used. In alternative embodiments, multiple points can be measured, such as two, five, or ten points. In other embodiments, alternative methods for measuring the thickness can be used, such as by manually measuring the thickness by hand, or by using other devices such as lasers or pin gauges to estimate the thickness. Other methods and devices can also be used.

Once the thickness of the current liner assembly has been measured, control is passed to operation 140, and the measurement point of the current thickness of the liner assembly is stored to build a database of historical measurements. In addition, the current thickness is compared to the historical wear model. Based on this comparison, an estimated wear profile is built. In example embodiments, the estimated wear profile is extrapolated from the historical wear model. An example method for building the estimated wear profile is shown and described below in reference to FIGS. 4 and 5.

Once the estimated wear profile is generated, control is passed to operation 150, and performance characteristics associated with the estimated wear profile are examined. For example, in one embodiment, the estimated wear profile is reviewed to estimate the consumption and/or wear rate for the liner assembly. In other embodiments, other performance characteristics, such as mill through put, can be examined.

Next, at operation 160, a determination is made as to whether or not to modify operations of the milling process based on the review of the estimated wear profile. For example, in one embodiment, the consumption of the liner assembly is examined to determine whether or not to replace the current liner assembly based on the estimated wear profile. In other embodiments, the modification of other performance characteristics such as, for example, percent filling, solids density, mill speed, etc., can also be contemplated.

If performance is to be modified based on the review of the wear profile (e.g., the estimated wear profile indicates that the liner assembly should be replaced), control is passed to operation 170, and the necessary performance modifications are implemented (e.g., the liner assembly is replaced). Alternatively, if the estimated wear profile indicates that no modifications need to be made (e.g., the liner assembly has further useful life), control is passed back to operation 130, and further current measurement point(s) can be collected at a later time.

Figure 3:
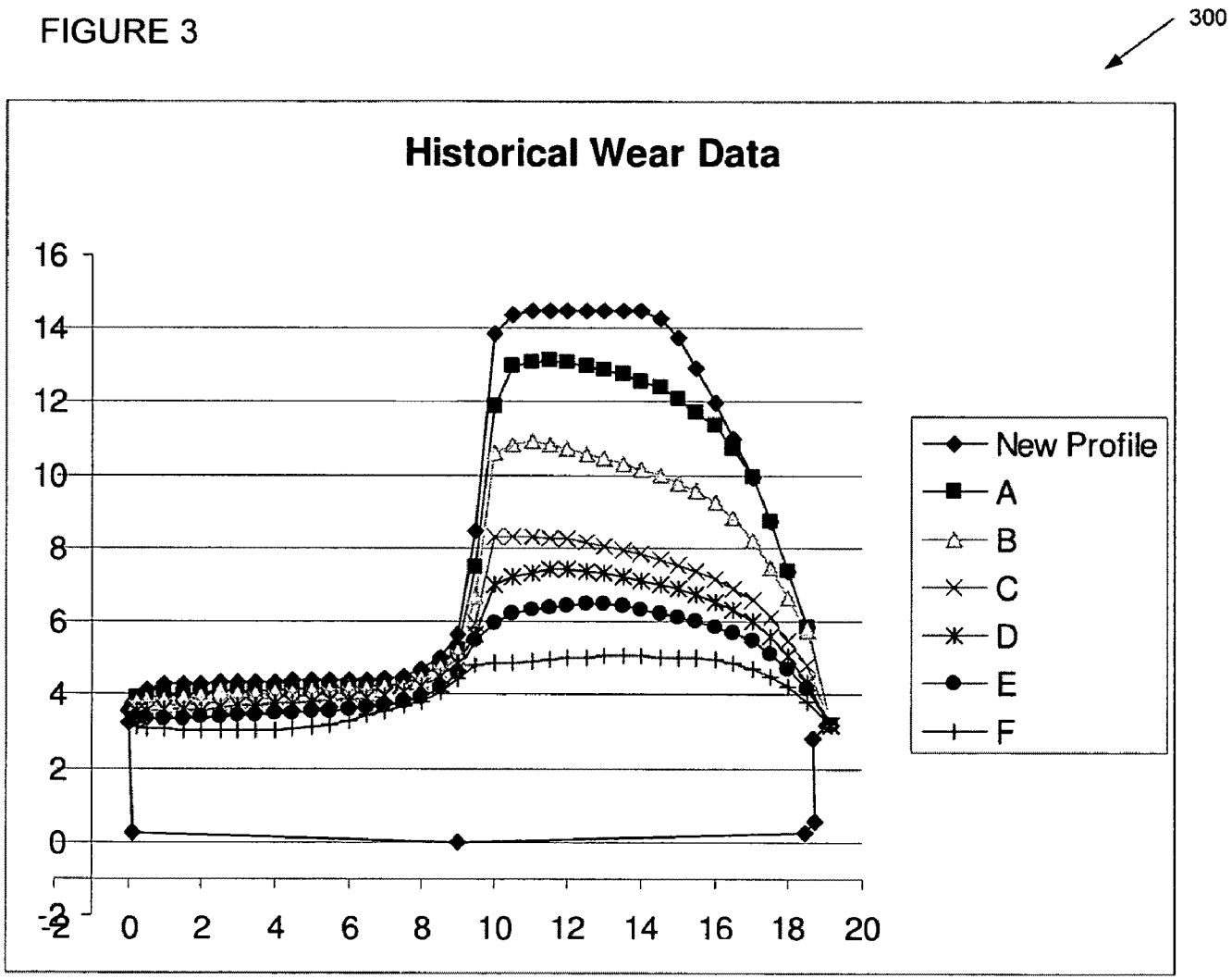
FIG. 3 illustrates an example diagram of the historical wear data from the table of FIG. 2.

Referring now to FIGS. 2 and 3, example historical data is shown. Table 200 shown in FIG. 2 includes historical data in rows 230 taken at a plurality of times A, B, C, D, E, F shown in columns 210, 212, 214, 216, 218, 220. For example, each column 210, 212, 214, 216, 218, 220 includes a plurality of measurement data collected at a known cumulative number of operating hours. The maximum historical value, or highest measured point, for each column 210, 212, 214, 216, 218, 220 is noted in row 240. Example historical wear models from the historical data of Table 2 are shown in diagram 300 of FIG. 3.

Figure 4:
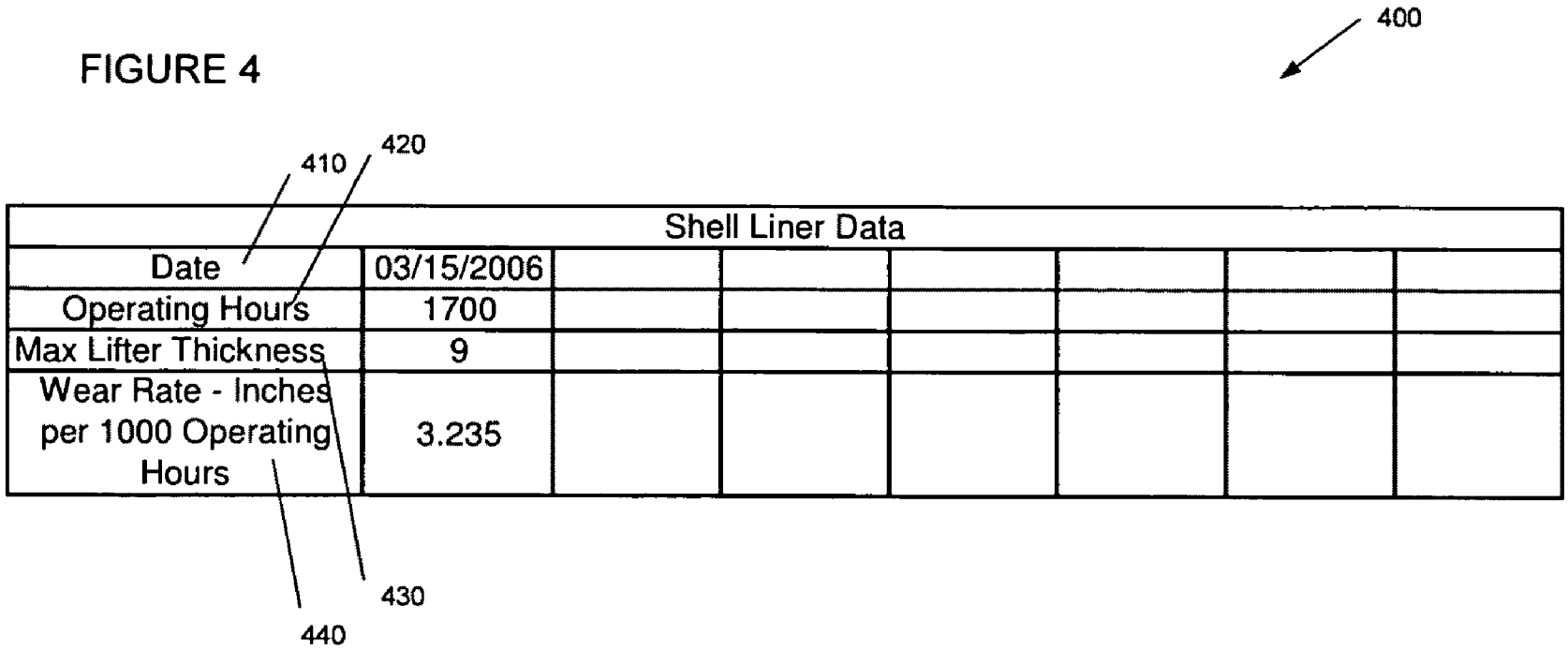
FIG. 4 illustrates an example graphical user interface for a user to enter a current wear measurement point to obtain performance characteristics.

Referring now to FIG. 4, an example graphical user interface 400 is shown. Interface 400 includes a date row 410, an operating hours row 420, a maximum lifter height row 430, and a wear rate row 440. Interface 400 also includes a plurality of columns into which the user can enter data associated with rows 410, 420, 430. For example, in the embodiment shown, the user has entered a data of Mar. 15, 2006 to indicate the data at which a current measurement has been taken. The user has also entered the number of operating hours of 1700 representing the number of hours the mill has been operating using the current liner assembly. The user also entered a current measurement of 9 inches, which represents the highest point on the measured liner assembly. Based on this information, the interface is programmed to provide performance characteristics including an estimated wear profile for the user, as described below.

Specifically, the current measurement of 9 inches is compared to the historical data in Table 2 of FIG. 2. The highest points 240 of Table 200 are examined and a determination is made as to between which two highest points 240 the current measurement of 9 falls. In the example shown, the current measurement of 9 falls between the highest points 240 for the second column 212 (10.91 inches) and third column 214 (8.33 inches). The percentage the current measurement of 9 inches falls between the two points is then calculated as follows in the current example:

$$\frac{9-8.33}{10.91-8.33}=0.25969 \text{ percentage between historical data points}$$

This percentage is then used to calculate each estimated point in the estimated wear profile. For example, for the first point in row 230 for columns 212, 214 of Table 200, the estimated point is calculated as follows:

$$(3.77-3.65)\times 0.25969+3.65=3.681163$$

The remaining points in the estimated wear profile are calculated in a similar fashion.

Figure 5:
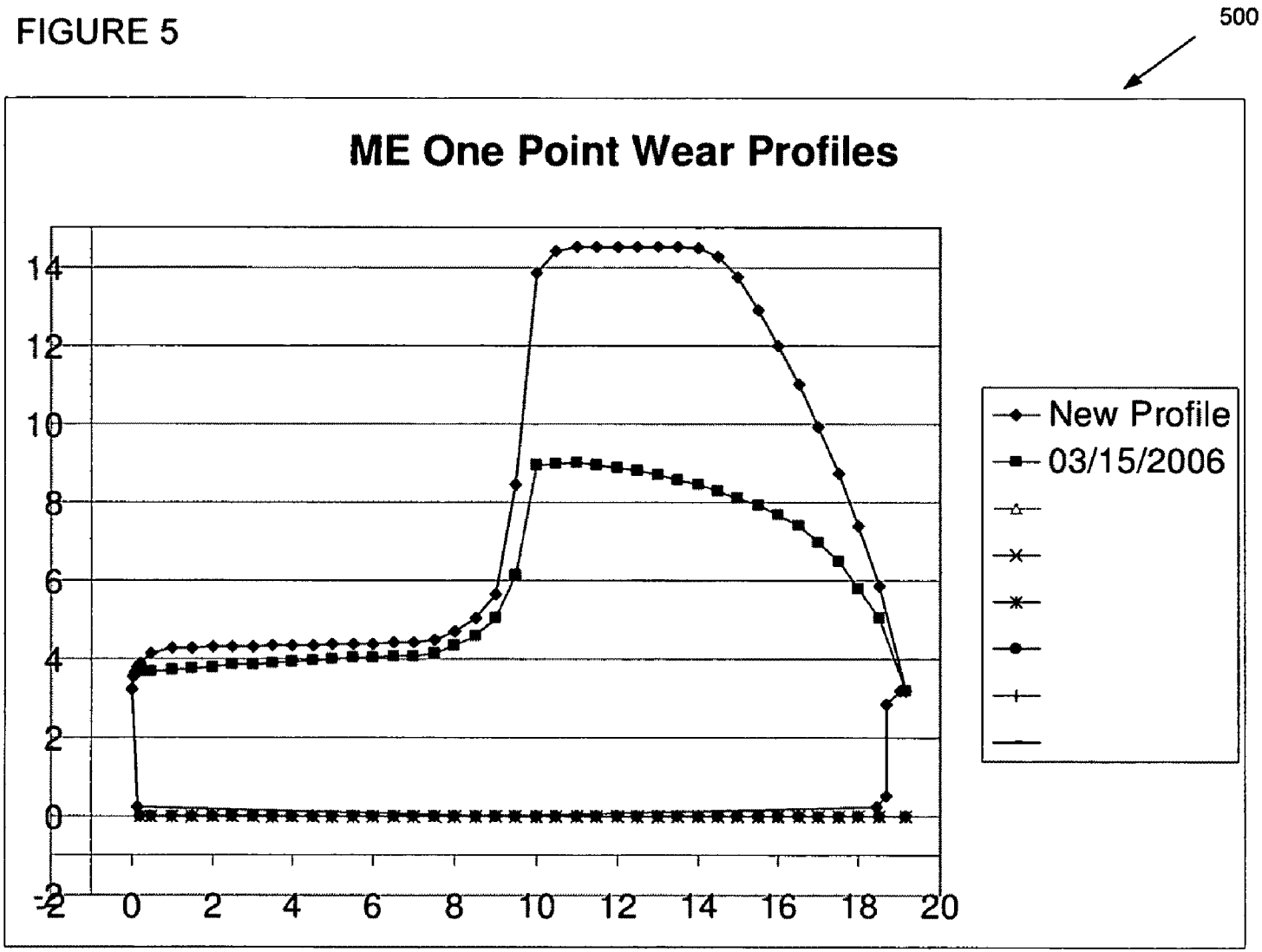
FIG. 5 illustrates an example diagram of the estimated wear data.

Referring now to FIG. 5, the estimated wear profile can be displayed graphically to the user as diagram 500. The wear profile can be used to visually contrast the estimated wear profile with historical wear profiles to make operating and performance decisions, such as when to replace the liner assembly.

In alternative embodiments, other methods for calculating the estimated wear profile can be used. For example, other methods of extrapolation, such as non-linear extrapolation methods including circular, conic, or polynomial, can also be used.

Referring back to FIG. 4, user interface 400 can also be used to collect other information from and/or provide other information to the user. For example, estimated wear rate data in wear rate row 440 can be calculated by using the maximum original thickness for the liner assembly (14.5 inches in the example), the current maximum thickness (9 inches), and the number of operating hours (1700) as follows:

$$\frac{14.5-9}{1700}\times 1000=3.235 \text{ inches}/(1000 \text{ operating hours})$$

The estimated wear rate of 3.235 inches per 1000 operating hours can be compared to historical data to optimize mill performance. For example, if the wear rate changes significantly from historical values, operating parameters can be examined and optimized based on the noted change.

In alternative embodiments, other performance characteristics can also be examined. For example, other performance characteristics such as liner consumption and mill through put can be calculated, and the results can be compared with historical data for the mill and/or other mills with similar operating parameters. In yet other embodiments, other information such as, for example, an estimated change-out date for the current liner assembly, can also be provided based on the estimated wear profile and historical data. Other information and configurations are possible.

Figure 6:
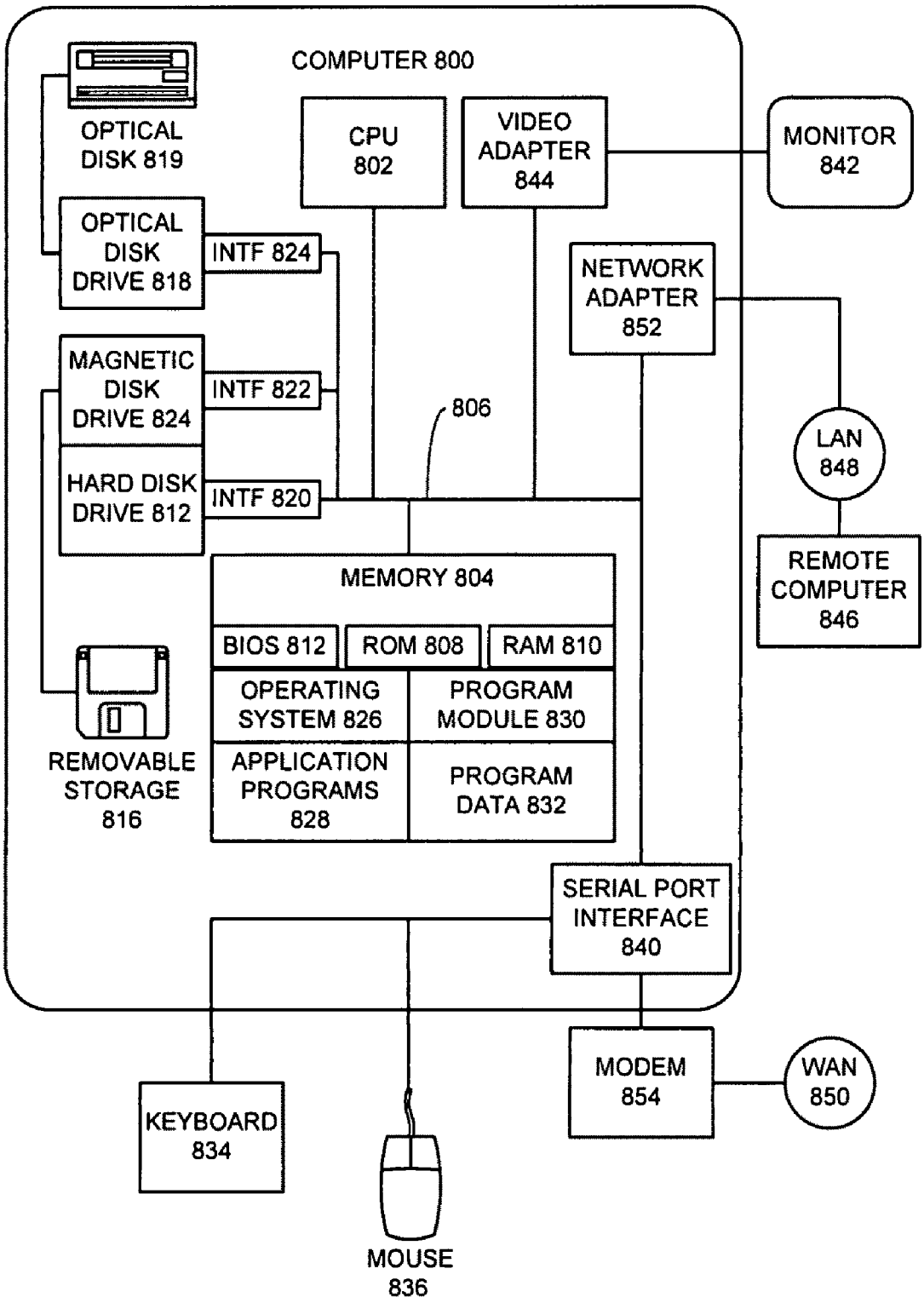
FIG. 6 illustrates an example computer system.

Referring now to FIG. 6, in example embodiments disclosed herein, the historical and estimated wear profiles are calculated using a computer 800. Computer system 800 can take a variety of forms such as, for example, a desktop computer, a laptop computer, and a hand-held computer. In addition, although computer system 800 is illustrated, the systems and methods disclosed herein can be implemented in various alternative computer systems as well.

System 800 includes a processor unit 802, a system memory 804, and a system bus 806 that couples various system components including the system memory 804 to the processor unit 802. System memory includes read only memory (ROM) 808 and random access memory (RAM) 810. A basic input/output system 812 (BIOS), which contains basic routines that help transfer information between elements within computer system 800, is stored in ROM 808.

Computer system 800 further includes a hard disk drive 812 for reading from and writing to a hard disk, a magnetic disk drive 814 for reading from or writing to a removable magnetic disk 816, and an optical disk drive 818 for reading from or writing to a removable optical disk 819 such as a CD ROM, DVD, or other optical media. Hard disk drive 812, magnetic disk drive 814, and optical disk drive 818 are connected to the system bus 806 by a hard disk drive interface 820, a magnetic disk drive interface 822, and an optical drive interface 824, respectively. The drives and their associated computer-readable media provide nonvolatile storage of computer readable instructions, data structures, programs, and other data for computer system 800. Removable magnetic disk 816, and a removable optical disk 819, and other types of computer-readable media capable of storing data can also be used in the example system 800.

A number of program modules can be stored on hard disk 812, magnetic disk 816, optical disk 819, ROM 808, or RAM 810, including an operating system 826 such as the WINDOWS operating system from Microsoft Corporation, one or more application programs 828, other program modules 830, and program data 832.

A user can enter commands and information into computer system 800 through input devices such as, for example, a keyboard 834, mouse 836, or other pointing device. Examples of other input devices include a toolbar, menu, touch screen, microphone, joystick, game pad, pen, satellite dish, and scanner. These and other input devices are often connected to the processing unit 802 through a serial port interface 840 (or Universal Serial Bus (USB)—not shown) that is coupled to the system bus 806. A display 842 is also connected to the system bus 806 via an interface, such as a video adapter 844. In addition to the display 842, computer systems can typically include other peripheral output devices (not shown), such as speakers and printers.

Computer system 800 can operate in a networked environment using logical connections to one or more remote computers, such as a remote computer 846. The network connections include a local area network (LAN) 848 and a wide area network (WAN) 850. Such networking environments are commonplace in offices, enterprise-wide computer networks, intranets, and the Internet. When used in a LAN networking environment, the computer system 800 is connected to the local network 848 through a network interface or adapter 852. When used in a WAN networking environment, computer system 800 typically includes a modem 854 or other means for establishing communications over the wide area network 850, such as the Internet.

The embodiments described herein can be implemented as logical operations in a computing system. The logical operations can be implemented (1) as a sequence of computer implemented steps or program modules running on a computer system and (2) as interconnected logic or hardware modules running within the computing system. This implementation is a matter of choice dependent on the performance requirements of the specific computing system. Accordingly, the logical operations making up the embodiments described herein are referred to as operations, steps, or modules. It will be recognized by one of ordinary skill in the art that these operations, steps, and modules may be implemented in software, in firmware, in special purpose digital logic, and any combination thereof without deviating from the spirit and scope of the disclosure. This software, firmware, or similar sequence of computer instructions may be encoded and stored upon computer readable storage medium and may also be encoded within a carrier-wave signal for transmission between computing devices.

Figure 7:
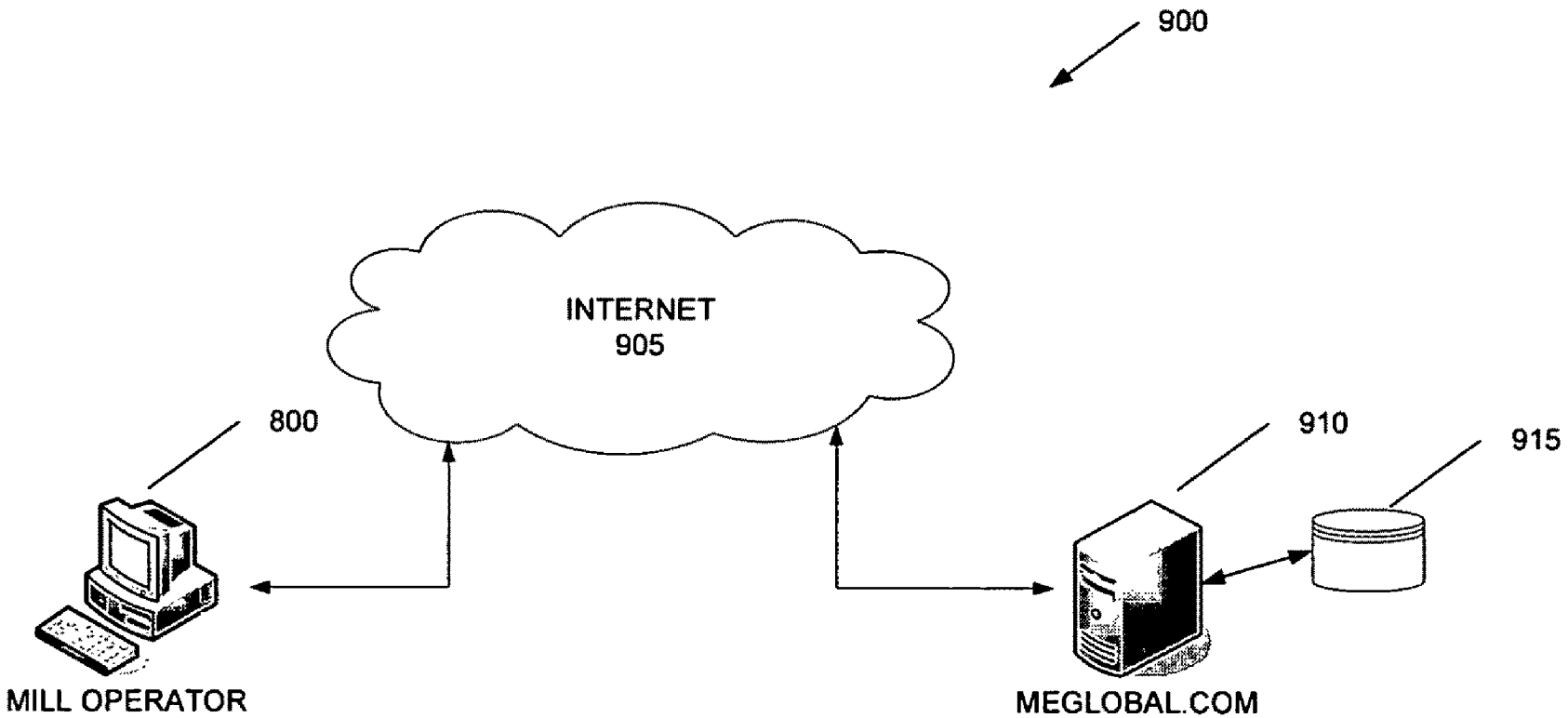
FIG. 7 illustrates an example system including the computer system of FIG. 6.

Referring now to FIG. 7, an example system 900 is shown. System 900 includes computer system 800, as well as a server 910 connected to a database 915. Computer system 800 is connected to server 910 through a network 905 such as the Internet. In alternative embodiments, network 905 can be a LAN or WAN.

In examples disclosed herein, computer system 800 connects to system 900 to perform various tasks. In one example, computer system 800 connects to system 900 to retrieve historical wear data from one or more data repositories associated with system 900, such as database 915. System 900 can be used as a data clearinghouse to store historical data from a plurality of locations and for a plurality of types of liner assemblies in database 915. As the amount of historical data in the data repositories associated with system 900 grows, the user can access the historical data to estimate performance characteristics, such as wear profiles, for consumable wear products such as liner assemblies. These comparisons can be done based on data from the same mine, or data for another comparably-equipped mine so that performance can be optimized.

In some embodiments, system 900 can also be programmed to perform the calculations necessary to estimate wear profiles and other performance characteristics based on information from the user of computer system 800. For example, in one embodiment, system 900 includes a web server that hosts a web site that is accessible using HTTP and other protocols associated therewith. The user accesses a web-based graphical user interface hosted on system 900 through a web browser running on computer system 800. The user provides information, such as historical wear data and a current measurement point. System 900 is programmed to build a historical wear model based on the historical data from the user, and to generate an estimated wear profile based on the current measurement point. This information is provided to the user.

In one embodiment, the user need not always provide historical wear data. Instead, the user can simply provide certain biographical information about the user's liner assembly, such as the grinding mill type, liner material type, and hours of operation. System 900 is programmed to use this information to access relevant historical data from repositories associated with system 900. System 900 accesses the relevant historical data and builds a historical wear model. The user can then provide a current measurement point, and system 900 can generate an estimated wear profile.

Figure 8:
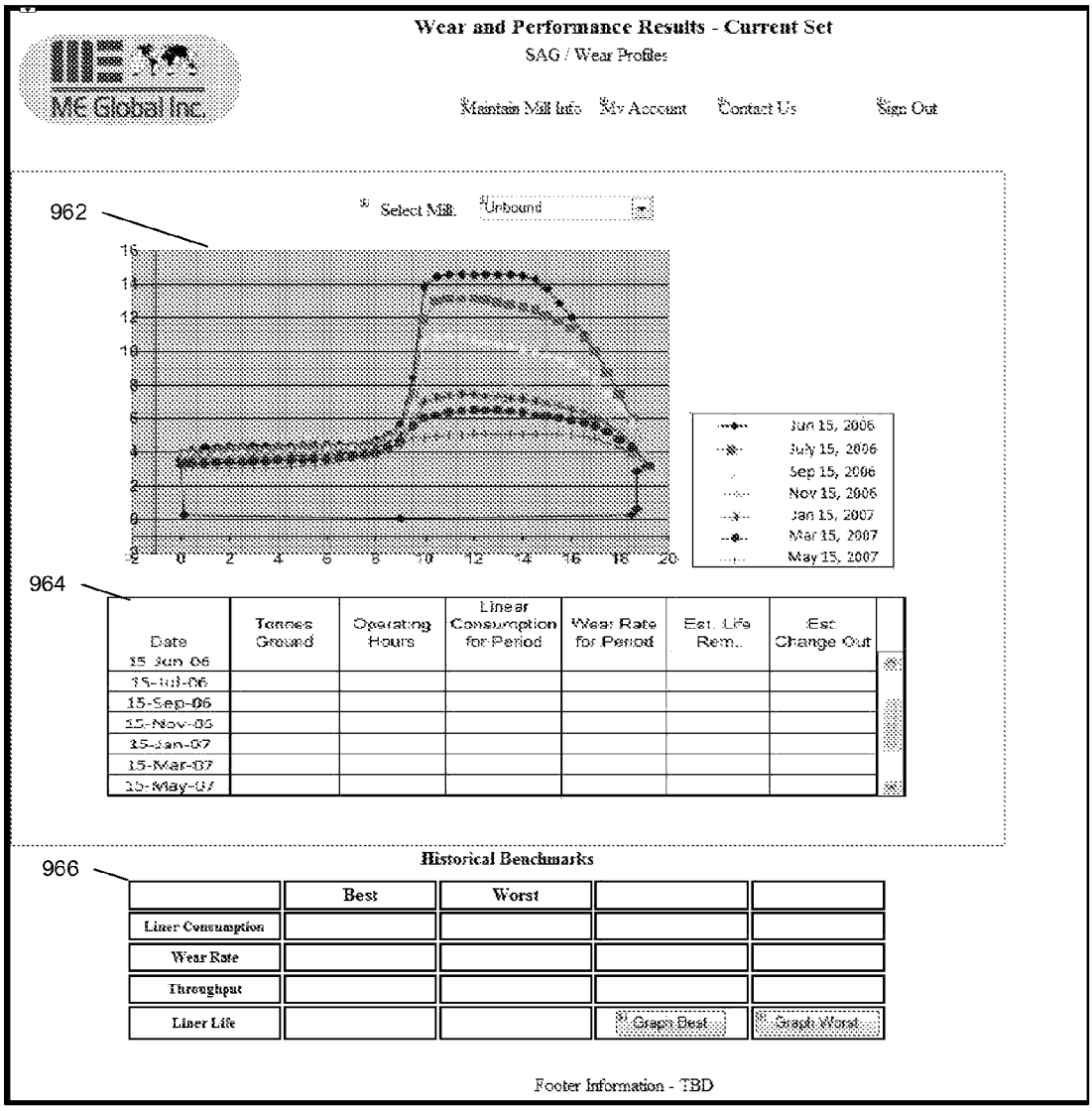
FIG. 8 illustrates an example graphical user interface of the system of FIG. 7.

Referring now to FIG. 8, an example web-based graphical user interface 960 hosted on system 900 is shown. In one embodiment, a user accesses user interface 960 through a web browser running on computer system 800. The user is assigned login and password information that is unique to the user, such that the user can access information associated with wear profiles of the user's mill after logging into the system 900.

User interface 960 includes a graph of wear profiles 962, a chart of performance results associated with the wear profiles for the current set of liners installed 964, and a chart showing some key historical figures 966 based on historical benchmarked data. A legend on the graph identifies the profiles by date. The XY values are calculated by the system based upon historical data, as described further herein.

Figure 9:
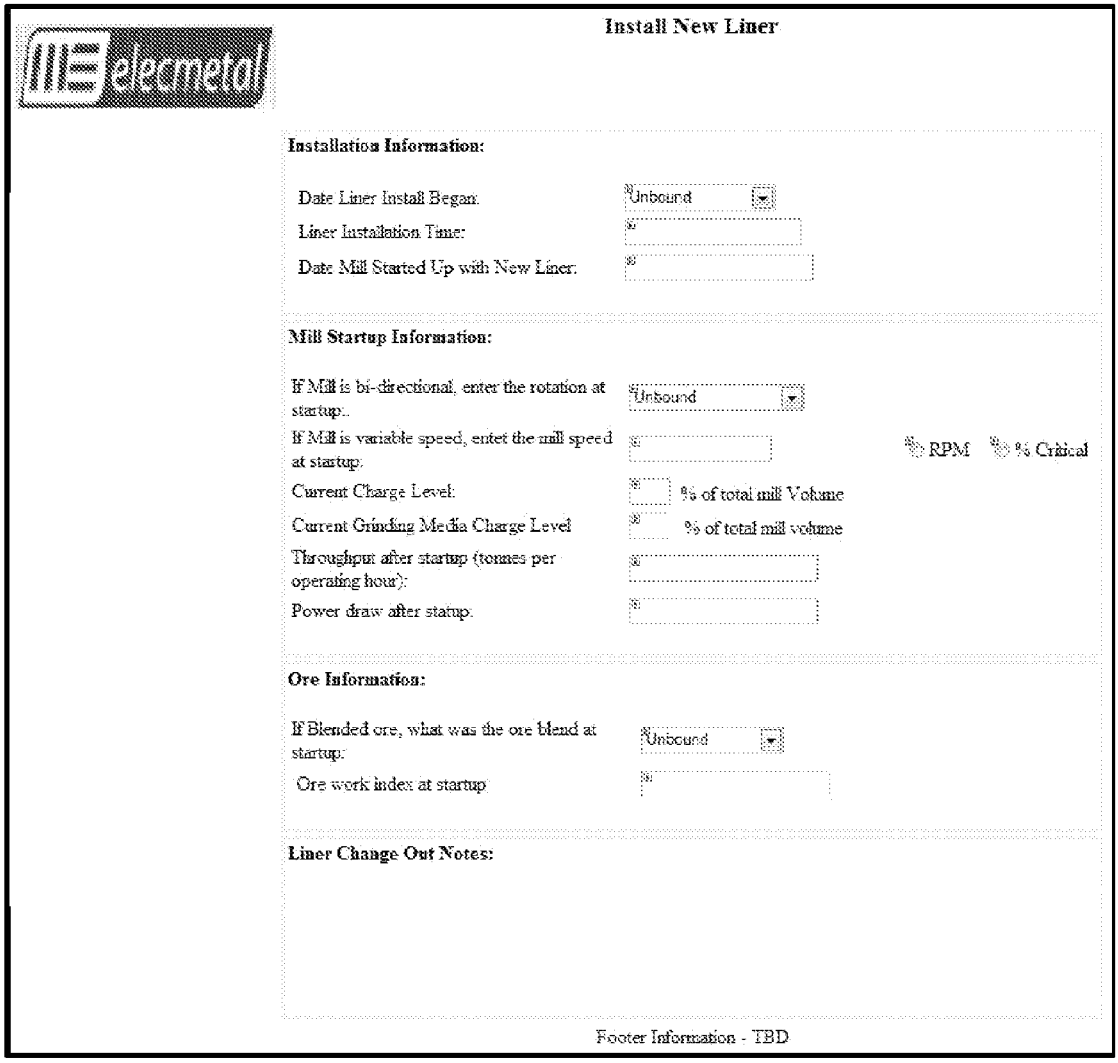
FIG. 9 illustrates another example graphical user interface of the system of FIG. 7.

Referring now to FIG. 9, a user interface 970 allows a user to input a plurality of information about a liner. Such information can include, for example, installation date/time, mill information, and ore information. Other information can also be used.

System 900 will also allow users to upload historical wear data to database 915. Once the data is obtained, it is uploaded in the database. After the historical data is provided, single point data can then be input going forward to estimate wear profiles. In one example, historical data is provided in an AutoCAD profile format, which can be exported in XY coordinates to database 915, or into an Excel format. Historical data can be uploaded any time a new liner design is installed for a mill.

In example embodiments, system 900 uses the historical data that is uploaded as follows. The liner consumption for the period is calculated as follows:

$$\text{Liner Consumption} = \frac{(\text{Area Under Curve Previous Period} - \text{Area Under Curve Current Period (square inches)}) \times (\text{Effective Grinding Length of Mill (inches)}) \times (\#\text{ of rows of liners}) \times (.28\text{ lb/cubic inch}) \times (454\text{ grams per lb})}{\text{total current tons ground} - \text{total current tons ground previous period}}$$

The wear rate is calculated as follows:

$$\text{Liner Wear Rate} = \frac{\text{Maximum } Y \text{ Value in Data Set previous period} - \text{Maximum } Y \text{ value in data set current period}}{\frac{\text{days in current period}}{7}}$$

The estimated life remaining for the liner is calculated as follows:

1. Iterate historical unit of life measure based on current wear profile. Days are used as an example. A date is associated with each XY coordinate historical profile data set. When the current thickness is entered, the relation of that data point to the historical data must be calculated. The percentage difference between the current point and the nearest highest points of historical data points can be calculated. Once this percentage is calculated, it is applied to the number of days between the dates associated with the two nearest historical profiles (nearest being one higher profile and one lower profile). This number of days is added to the total days of wear required to reach the highest historical profile being used for the iteration. This will give an iterated historical number of days of wear life that can be compared to the current days of life.
2. Subtract days of liner life at historical change out from iterated days of liner life. This will then give the number of days remaining if the current liners are wearing at the same rate as the historical set.
3. Compare the iterated historical life to the current life to get a ratio of current days of life to historical days of life. The current life should be divided by the historical iterated life. The result is the ratio of the current wear rate to the historical wear rate.
4. Multiply wear rate ratio by the total calculated in Step 2. This will yield the estimated life remaining in days.

Finally, the estimated change out date is calculated as follows:

Estimated Change Out Date=number days of estimated life remaining+current date

Other configurations are possible.

In another example, system 900 will prompt the user to enter information about a new set of liners when an old liner is removed. The system will ask if the design has changed for the set being installed. Various information will be gathered from the user, such as: one point data; date; if bidirectional rotation, rotation summary for measurement period (e.g., how many times did mill rotation switch, and how long did mill run in each direction?); if variable speed, speed summary for measurement period (e.g., was speed constant, was speed increased/decreased during measurement period, if there were many changes in speed, and what was the average speed for the period?); current total charge level (% of mill volume); current grinding media charge level (% of mill volume); current throughput (tonnes per operating hour); average throughput for measurement period (tonnes per operating hour); operating time for period (hours); tonnes ground for period (hours); if blended ore, what was ore blend for the measurement period?; what is average ore work index for measurement period?; and location of highest wear area on shell liners (i.e., one point measurement point); current power draw, average power draw for measurement period. After all data is entered, an email is sent to user for review and approval of the information.

System 900 can also have various other user interfaces as well. In one example, a mill detail page is provided that includes information such as liner type and use, ore, and operating parameters for each mill. Examples of parameters that can be entered that may affect historical performance data include: mill rotation, mill speed, mill speed range, total charge level, discharge type, pebble crusher installed, pebble port size, tonnes per hour, media type, media charge level, media addition size, grinding media hardness, largest feed lump size, mill has circulating load, work index, abrasion index, and blended.

Another page lists each mill name and allows for access information such as historical wear profiles for the liners located at each of the mills. In another example, administrative pages are provided that allow for access and manipulation of user login information by administrators of the system, such as user bibliographic information and login names and passwords. In another example, the system 900 also includes interfaces that allow users to anonymously share historical wear data. This data can be shared with other users for benchmarking purposes.

One or more advantageous are associated with the systems and methods disclosed herein. For example, the use of historical data allows for a minimal number of current measurement points (e.g., one measurement point) to be used to generate an estimated wear profile, thereby increasing the efficiency of previous methods for gathering wear profile information involving multiple measurement points. The use of historical data also enhances the accuracy of the estimated wear profiles.

Although the examples herein are described with respect to a liner assembly for a grinding mill, the systems and methods disclosed herein can be applied to other consumable wear products as well. For example, in alternative embodiments, historical and estimated wear profiles can be generated for other consumable wear products such as, for example and without limitation, liners for crushers, chutes, and pump casings. Other applications are also possible.

The various embodiments described above are provided by way of illustration only and should not be construed to limiting. Those skilled in the art will readily recognize various modifications and changes that may be made to the embodiments described above without departing from the true spirit and scope of the disclosure or the following claims.

What is claimed is:

1. A method for estimating a wear profile of a liner assembly of a grinding mill that processes ore, the method comprising:

building a historical wear model based on historical data from the grinding mill;

obtaining a current single measurement point for the liner assembly;

extrapolating an estimated wear profile using the current single measurement point and the historical wear model; and estimating a change-out date for the liner assembly based on the estimated wear profile.

2. The method of claim 1, further comprising estimating a wear rate of the liner assembly.

3. The method of claim 1, further comprising estimating a consumption rate of the liner assembly.

4. The method of claim 1, further comprising estimating a through put for the grinding mill using the liner assembly.

* * * * *